US006626365B2

(12) United States Patent
Kobayashi et al.

(10) Patent No.: US 6,626,365 B2
(45) Date of Patent: Sep. 30, 2003

(54) EXPANSION VALVE

(75) Inventors: Kazuto Kobayashi, Tokyo (JP); Masamichi Yano, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/152,865

(22) Filed: May 23, 2002

(65) Prior Publication Data

US 2002/0185545 A1 Dec. 12, 2002

(30) Foreign Application Priority Data

May 29, 2001 (JP) ..... 2001-160246

(51) Int. Cl.[7] ..... F25B 41/04
(52) U.S. Cl. ..... 236/92 B; 62/225
(58) Field of Search ..... 236/92 B; 62/225

(56) References Cited

U.S. PATENT DOCUMENTS 4,819,443 A * 4/1989 Watanabe et al. ..... 62/225
4,979,372 A * 12/1990 Tanaka ..... 62/225
5,060,485 A * 10/1991 Watanabe et al. ..... 62/225
5,127,237 A * 7/1992 Sendo et al. ..... 62/225
6,112,998 A * 9/2000 Taguchi ..... 236/92 B

FOREIGN PATENT DOCUMENTS

JP H05-322380 12/1993

* cited by examiner

*Primary Examiner*—William E. Tapolcal
(74) *Attorney, Agent, or Firm*—Rader, Fishman & Grauer PLLC

(57) ABSTRACT

An expansion valve 1 comprises a piping member 10 equipped with passages to which refrigerant pipes are to be connected, and a cassette unit 100, the two members being formed as separate units. The cassette unit 100 comprises a tube member 110 having a flange portion 111, and at the interior of the tube member 110 are fixed a guide member 170, an orifice member 180, and a plate member 166. The pressure of gas filled in a gas charge chamber 122 defined by a lid 120 and a diaphragm 130 displaces the diaphragm 130, the displacement being transmitted to a shaft member 150 through a stopper member 140 including at the center thereof a tubed portion 142 storing an absorbent. The shaft member 150 is guided by a guide member 170 and controls the valve means 160 inside a valve chamber 161. The cassette unit 100 is inserted to the piping member 10 and fixed to position by a ring 50. Seal members 62, 64, and 66 are equipped to appropriate areas between the cassette unit and the piping member.

6 Claims, 6 Drawing Sheets

EXPANSION VALVE

FIELD OF THE INVENTION

The present invention relates to an expansion valve mounted to a refrigeration cycle of an air conditioner equipped for example in a vehicle, and especially relates to an expansion valve for automatically controlling the amount of refrigerant supplied to an evaporator in correspondence to the temperature of the refrigerant in a low-pressure refrigerant passage through which the refrigerant traveling from an evaporator toward a compressor travels.

DESCRIPTION OF THE RELATED ART

A conventionally known expansion valve is equipped with a temperature sensing chamber that changes its pressure by sensing the change in refrigerant temperature traveling from an evaporator and through a low-pressure refrigerant passage toward a compressor, and a valve drive mechanism comprising a valve drive member and a valve means driven according to this pressure change in the temperature sensing chamber and thereby controlling the flow of the refrigerant traveling from the compressor toward the evaporator.

According however to this conventional expansion valve, a so-called hunting phenomenon sometimes occurs where the valve means opens and closes repeatedly.

Therefore, Japanese Patent Laid-Open Provisional Publication No. 5-322380 discloses filling an absorbing agent such as an activator to a hollow valve drive member and preventing such hunting phenomenon from occurring to the conventional expansion valve.

According to the above mentioned expansion valve disclosed in Japanese Patent Laid-Open Provisional Publication No. 5-322380, the overall structure of the expansion valve is rather complicated, utilizing for example a screw mechanism for fixing the power element portion constituting the temperature sensing chamber to the valve body. Thus, much cost is required for preparing the parts of the expansion valve and assembling the same.

SUMMARY OF THE INVENTION

Therefore, the present invention aims at providing an expansion valve having a simplified structure, by composing the expansion valve with a piping member and a cassette unit provided with all the functions of the expansion valve.

The expansion valve according to the present invention comprises a piping member including refrigerant passages to which pipes communicated with various equipments of the air conditioner are connected; a cassette unit inserted to the piping member, the cassette unit comprising a tube member formed integrally with a flange unit, a guide member, an orifice member, and a plate member fixed to the inside of the tube member, a valve means equipped inside a valve chamber defined by said orifice member, a plate member further defining said valve chamber, a spring disposed between the plate member and the valve means for biasing the valve means toward the orifice member, a shaft member for driving the valve means, a lid member welded onto the flange portion, a diaphragm pinched between the lid member and the flange portion and defining a gas charge chamber, and a stopper member having at the center thereof a tubed portion filled with absorbent for transmitting the displacement of the diaphragm to the shaft member; the expansion valve further comprising a ring for fixing to the piping member the lid member of the cassette unit inserted to the piping member; and a seal member disposed between the outer wall of the cassette unit and the inner wall of the piping member.

Further, the axis line of the refrigerant passage formed to the piping member is designed to correspond to the layout of the pipes.

Moreover, the present expansion valve can include a rubber bush equipped to the exterior of the tube member, and a rubber seal member baked onto the exterior of the tube member.

Even further, the guide member, the orifice member, and the plate member are fixed to the tube member through caulking.

DETAILED DESCRIPTION OF THE PREFERRED EMBODIMENT

Figure 1:
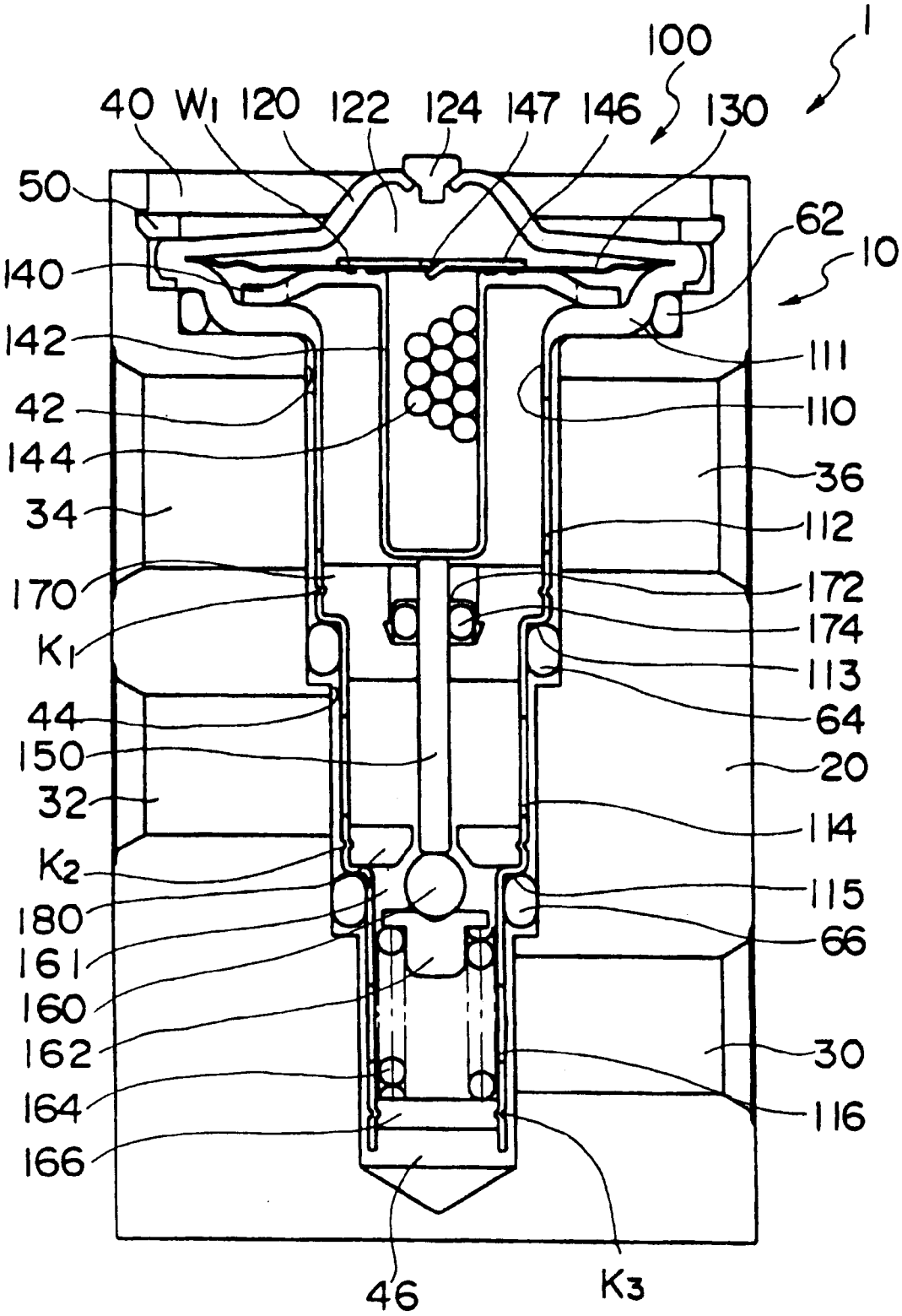
FIG. 1 is a cross-sectional view showing the overall structure of the expansion valve according to the present invention.

FIG. 1 is a cross-sectional view showing one embodiment of the expansion valve including a cassette structure according to the present invention.

An expansion valve denoted as a whole by reference number 1 is equipped with a piping member 10 and a cassette unit 100 formed separately from the piping member 10.

The piping member 10 comprises a body 20 formed of an appropriate material such as aluminum, and the body 20 includes a passage 30 that connects to a pipe through which travels a refrigerant supplied from a compressor not shown, a passage 32 that connects to a pipe through which travels the refrigerant traveling toward an evaporator (not shown), a passage 34 that connects to a pipe through which travels the refrigerant returning from the evaporator, and a passage 36 that connects to a pipe through which travels the refrigerant returning toward the compressor.

Stepped inner wall portions 40, 42, 44, 46 are machined to the center area of the body 20 in the direction orthogonal to the refrigerant passages. The inner wall portion 46 defines the bottom wall of a hole.

The cassette unit 100 inserted to the inner wall portion of the body 20 of the piping member 10 includes a tube member 110 formed for example by deep drawing stainless steel material. The tube member 110 is formed integrally with a flange unit 111 and further includes stepped portions 113 and 115. The end of the tube member 110 opposite from the flange portion 111 is opened.

A stopper member 140 is mounted to the flange portion 111, and a lid member 120 is welded integrally onto the flange portion pinching therein the circumference of a diaphragm 130 that comes into contact with the upper face of the stopper member 140. The lid member 120 and the diaphragm 130 define a gas charge chamber 122, the chamber being filled with a predetermined gas before being sealed with a plug 124. The gas charge chamber 122 and the diaphragm 130 constitute a power element portion, which functions as the drive mechanism of the valve. The end of the stopper member 140 is mounted on the flange portion 111, and the center area of the stopper member 140 constitutes a tubed portion 142, the tubed portion 142 being positioned within passages 34 and 36 constituting a low-pressure refrigerant passage through which the refrigerant sent out from the evaporator not shown toward the compressor travels. Further, a plate 146 is disposed on the diaphragm 130, and the stopper member 140, the diaphragm 130 and the plate 146 are fixed through a weld portion $W_1$.

An absorbent 144 such as activated carbon is filled within the tubed portion 142, which communicates to the gas charge chamber 122 through an opening 147.

Through holes 112, 114, and 116 are formed to the tube member 110 through which refrigerant travels. A shaft member 150 comes into contact with the bottom of the tubed portion 142 of the stopper member 140, wherein the diaphragm 130, the stopper member 140, and the shaft member 150 constitute a valve drive mechanism, and the shaft member 150 penetrates the guide member 170 and the opening of the orifice member 180 to come into contact at the other end with a valve means 160 positioned within a valve chamber 161.

The spherical valve means 160 is supported by a support member 162, and the support member 162 is further supported by a fix plate 166 through a spring 164.

The guide member 170 is equipped with a seal member 174 inserted thereto and fixed by a support member 172. The seal member 174 not only guides the shaft member 150, but also seals and prevents refrigerant from leaking between the passage 32 for the refrigerant traveling from the compressor not shown toward the evaporator and the passage 34 for the refrigerant returning from the evaporator. The guide member 170 having a cylindrical outer contour is fixed to the tube member 110 through a caulking portion $K_1$. Further, the orifice member 180 and the fix plate 166 are also fixed thereto through caulking portions $K_2$ and $K_3$, respectively.

The cassette unit 100 is inserted to the inner wall portion of the body 20 of the piping member 10 and fixed to position by a stop ring 50. Three sealing members 62, 64 and 66 are fit to the space between the inner wall portion of the body 20 and the cassette member 100, thereby defining a seal between the outer periphery of the cassette unit 100 and the inner wall portion of the body 20 of the piping member 10.

Through such structure, the temperature of the low-pressure refrigerant traveling from the evaporator through passages 34 and 36 toward the compressor is transmitted via the stopper member 140 to the gas charge chamber 122, by which the pressure of the gas filled within the gas charge chamber 122 changes, and this change in pressure is transmitted through the diaphragm 130, the stopper member 140 and the shaft member 150 to the valve means 160. Thereby, the valve means 160 is driven to move to a position where the above pressure change, the biasing force of the spring 164, and the refrigerant pressure within passages 34 and 36 are balanced, and the amount of refrigerant traveling from the compressor through the high-pressure refrigerant passage 30, the opening of the orifice member 180 and the passage 36 toward the evaporator is controlled. At this time, an activated carbon 144 is employed to prevent excessive response of the valve means 160 to the change in refrigerant temperature traveling through the low-pressure refrigerant passage.

Since a space or gap exists between the outer periphery of the tube member 110 of the cassette unit 100 and the inner wall portion of the body 20 of the piping member 10, the passages 30, 32, 34, and 36 formed to the piping member 10 can be designed freely.

Thereby, the piping design and the layout of the air conditioner can be set with greater freedom.

The cassette unit 100 comprises all the functions of an expansion valve by itself.

The piping member 10 exerts its function by the passages formed thereto which connects the refrigerant pipes to the cassette unit 100 provided with the functions of the expansion valve, so the design of the body and the passages of the piping member 10 can be determined freely.

However, it is important that a secure sealing performance is exerted by the seal structure provided between the cassette unit 100 and the piping member 10.

On the other hand, the tube member 110 of the cassette unit 100 is manufactured by deep drawing stainless steel material, so various structures can be employed considering the workability thereof.

Figure 2:
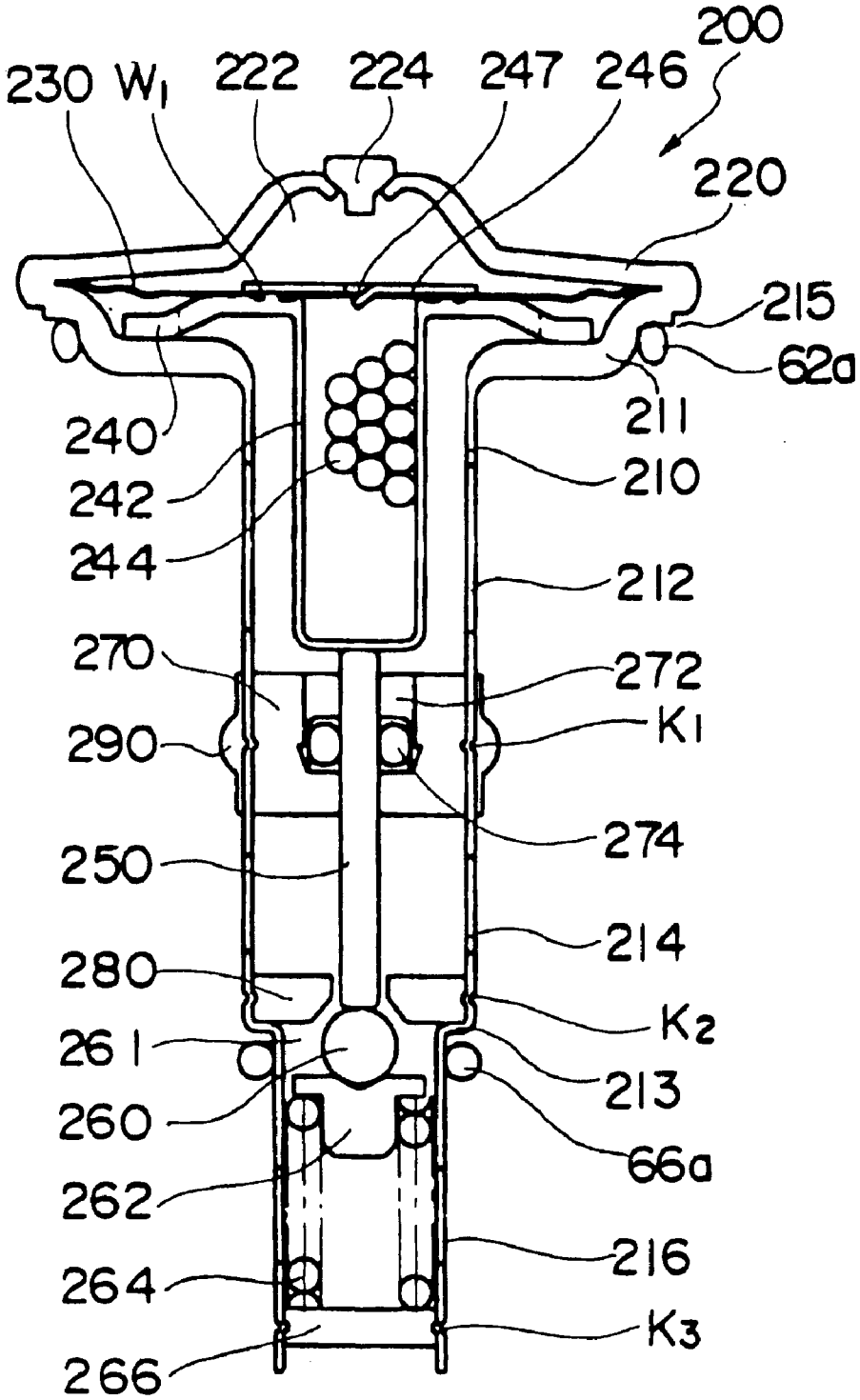
FIG. 2 is a cross-sectional view showing another example of the cassette unit of the expansion valve according to the present invention.

FIG. 2 is a cross-sectional view showing another embodiment of the cassette unit according to the present invention.

In comparison to the structure shown in FIG. 1, the present embodiment includes reduced number of stepped portions. According to FIG. 2, a cassette unit denoted as a whole by reference number 200 comprises a tube member 210 and a flange portion 211 formed integrally therewith, the tube member 210 having a stepped portion 213 and through holes 212, 214, and 216 through which refrigerant travels.

A stopper member 240 is mounted to the flange portion 211, and a lid member 220 is welded integrally to the flange portion pinching therein the circumference of a diaphragm 230 that comes into contact with the upper surface of the stopper member 240. The lid member 220 and the diaphragm 230 define a gas charge chamber 222 constituting the temperature sensing chamber, the chamber being filled with a predetermined gas before being sealed by a plug 224. This gas charge chamber 222 and the diaphragm 230 constitute the power element portion, which is the drive mechanism of the valve member. The end of the stopper member 240 is mounted on the flange portion, and the center area of the stopper member 240 constitutes a tubed portion 242, the tubed portion 242 being disposed within the passage of a low-pressure refrigerant coming out of an evaporator not shown and through a through hole 212 toward a compressor. Further, a plate 246 is mounted on the diaphragm 230, and the stopper member 240, the diaphragm 230 and the plate 246 are fixed together via a weld portion $W_1$.

An absorbent such as an activated carbon is filled within the tubed portion 242, which is communicated to the gas charge chamber 222 via an opening 247.

A shaft member 250 comes into contact with the bottom surface of the tubed portion 242, and the shaft member 250 penetrates a guide member 270 and an orifice member 280 and comes into contact at the other end with a valve means 260 positioned within a valve chamber 261, a valve drive mechanism being formed by the diaphragm 230, the stopper member 240 and the shaft member 250. The orifice member 280 is fixed to the tube member 210 through a caulking portion $K_2$.

The spherical valve means 260 is supported by a support member 262, and the support member 262 is further supported by a fix plate 266 via a spring 264. The fix plate 266 is fixed to the tube member 210 through a caulking portion $K_3$.

A seal member 274 is inserted to the guide member 270 and fixed thereto by a support member 272.

The seal member 274 not only guides the shaft member 250 but also seals any possible leak between the refrigerant traveling toward the evaporator and the refrigerant returning from the evaporator.

The guide member 270 comprises a cylindrical outer contour and is fixed to the cylindrical portion of the tube member 210 through the caulking portion $K_1$. A rubber bush member 290 is fit to the outer wall of the tube member 210 opposite the guide member 270.

The rubber bush member 290 defines a seal portion when the cassette unit 200 is inserted to the piping member 10. At this time, a seal member 66*a* is disposed at the stepped portion 213 of the tube member 210, and a seal member 62*a* is disposed at the stepped portion 215 of the flange portion 211.

The above explained embodiment realizes a tube member 210 capable of controlling the flow of refrigerant similarly as the one shown in FIG. 1 but with reduced stepped portions and thus is easier to manufacture.

Figure 3:
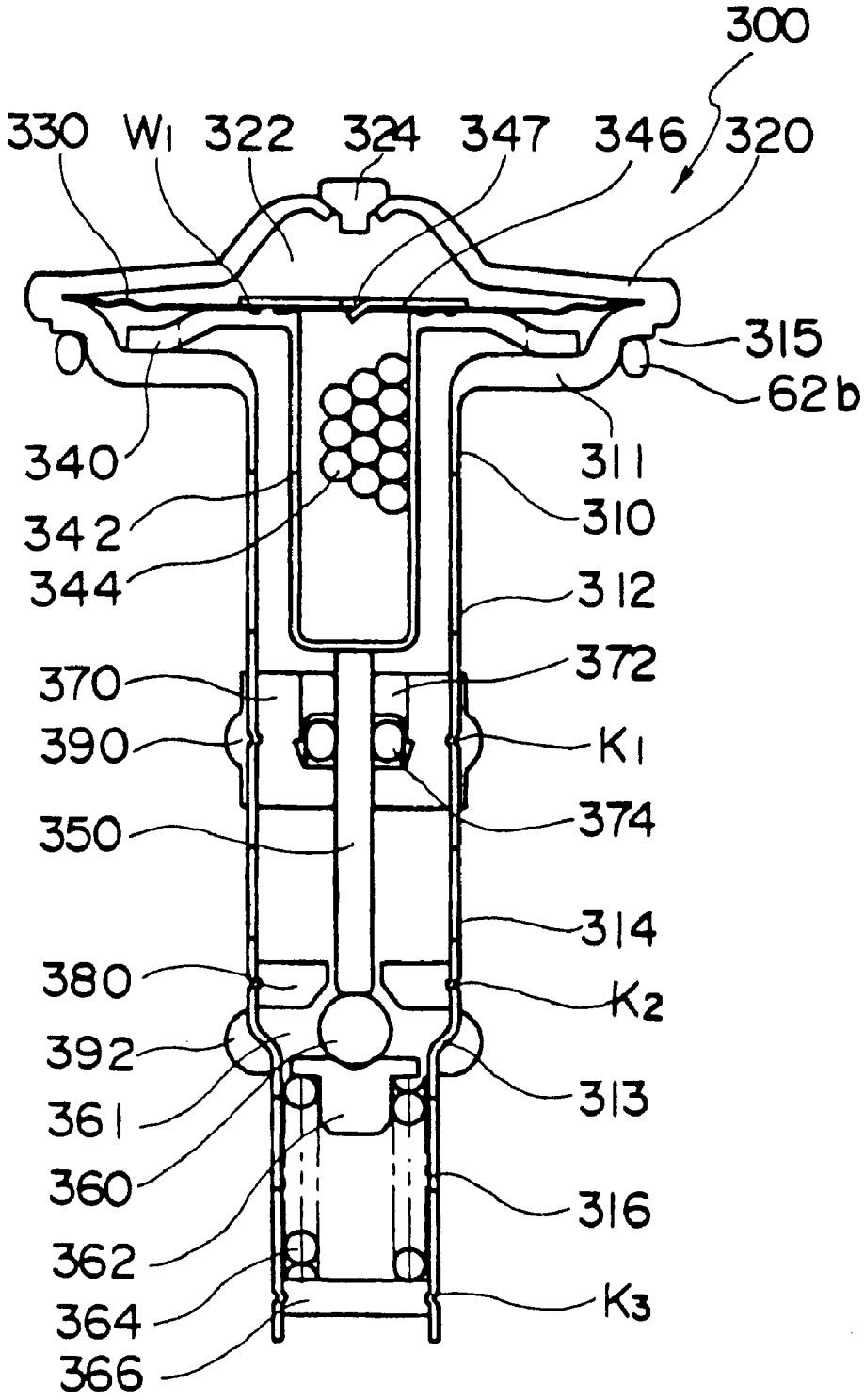
FIG. 3 is a cross-sectional view showing another example of the cassette unit of the expansion valve according to the present invention.

FIG. 3 is a cross-sectional view showing yet another embodiment of the cassette unit according to the present invention.

According also to this embodiment, the flow of refrigerant can be controlled by the same operation as in the embodiment of FIG. 1.

In the drawing, a cassette unit denoted as a whole by reference number 300 comprises a tube member 310 formed integrally with a flange portion 311, the tube member 310 including a stepped portion 313, and through holes 312, 314, and 316 through which refrigerant travels.

A stopper member 340 is mounted on the flange portion 311, and a lid member 320 is welded integrally to the flange portion pinching therein the circumference of a diaphragm 330 that comes into contact with the stopper member 340. The lid member 320 and the diaphragm 330 define a gas charge chamber 322 constituting the temperature sensing chamber, the chamber being filled with a predetermined gas before being sealed by a plug 324. The gas charge chamber 322 and the diaphragm 330 constitute the valve means drive mechanism. The end of the stopper member 340 is mounted on the flange portion 311, and the center area of the stopper portion 240 constitutes a tubed portion 342, the tubed portion 342 being disposed within the passage of a low-pressure refrigerant traveling from an evaporator not shown toward a compressor via a through hole 312. A plate 346 is mounted on the diaphragm 330, and the stopper member 340, the diaphragm 330 and the plate 346 are fixed by a weld portion $W_1$.

An absorbent 344 such as activated carbon is filled in the tubed portion 342, the tubed portion 342 being communicated to the gas charge chamber 322 via an opening 347.

A shaft member 350 comes into contact with the bottom surface of the tubed portion 342 of the stopper member 340, and the shaft member 350 penetrates a guide member 370 and an orifice member 380 and comes into contact at the other end with the valve means 360 disposed within the valve chamber 361. The diaphragm, the stopper member, and the shaft member constitute a valve means drive mechanism. The orifice member 380 is fixed to the tube member 310 through a caulking portion $K_2$.

The spherical valve means 360 is supported by a support member 362, and the support member 362 is supported through a spring 364 by a fix plate 366. The fix plate 366 is fixed to the tube member 310 through a caulking portion $K_3$.

A seal member 374 is inserted to the guide member 370 and fixed thereto by a support member 372.

The seal member 374 not only guides the shaft member 350 but also prevents any possible leak between the refrigerant traveling toward the evaporator and the refrigerant returning from the evaporator.

The guide member 370 comprises a cylindrical outer contour, and is fixed to the cylindrical wall of the tube member 310 through a caulking portion $K_1$. A rubber bush member 390 is fit to the outer wall of the tube member 310 opposite the guide member 370.

Moreover, a rubber seal member 392 is baked onto a stepped portion 313 of the tube member 310. A seal member 62*a* is disposed to a stepped portion 315 of the flange portion 311. The rubber bush member 390 and the seal members 392 and 62*a* constitute a seal when the cassette unit 300 is inserted to the piping member 10.

Figure 4:
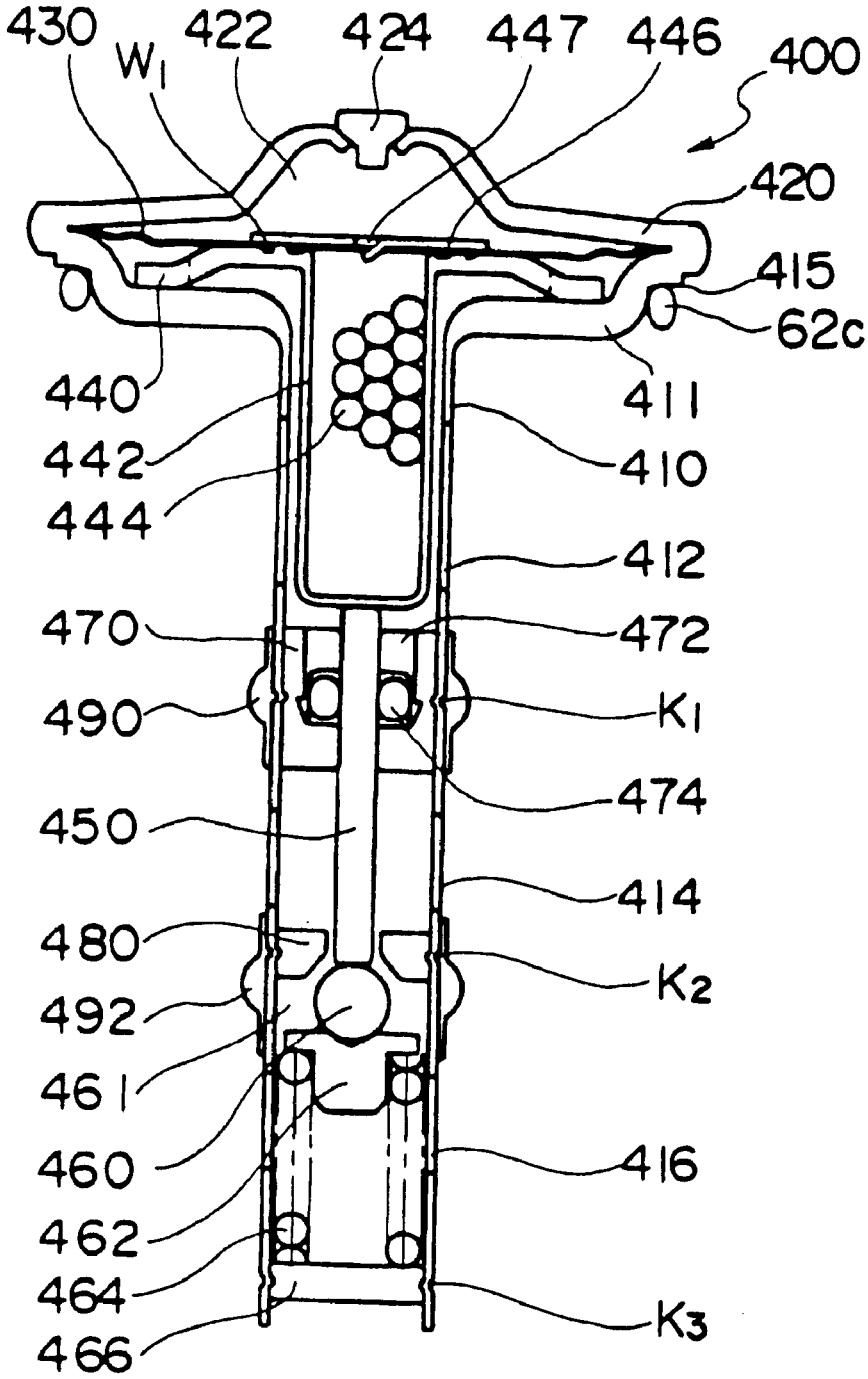
FIG. 4 is a cross-sectional view showing yet another example of the cassette unit of the expansion valve according to the present invention.

FIG. 4 is a cross-sectional view showing yet another embodiment of the cassette unit according to the present invention.

The present embodiment utilizes a tube member that does not include any stepped portion, but can operate similarly as the one shown in FIG. 1.

In the drawing, a cassette unit shown as a whole by reference number 400 comprises a tube member 410 formed integrally with a flange portion 411, the tube member formed to have a substantially straight cylindrical body with through holes 412, 414 and 416 formed thereto through which refrigerant travels.

A stopper member 440 is mounted on the flange portion 411, and a lid member 420 is welded integrally to the flange portion pinching therein the circumference of a diaphragm 430 that comes into contact with the stopper member 440. The lid member 420 and the diaphragm 430 define a gas charge chamber 422 functioning as a temperature sensing chamber, the chamber being filled with a predetermined gas before being sealed with a plug 424. The gas charge chamber 422 and the diaphragm 430 constitute the valve means drive mechanism. The end of the stopper member 440 is mounted on the flange portion 411, and the center area of the stopper member 440 constitutes a tubed portion 442, the tubed portion 442 being disposed in a low-pressure refrigerant passage through which travels the refrigerant coming from an evaporator not shown toward a compressor via a through hole 412. Moreover, a plate 446 is mounted on the diaphragm 430, and the stopper member 440, the diaphragm 430 and the plate 446 are fixed via a weld portion $W_1$.

An absorbent 444 such as an activated carbon is filled in the tubed portion 442, which communicates to the gas charge chamber 422 via an opening 447.

A shaft member 450 comes into contact with the bottom surface of the tubed portion 442 of the stopper member 440, and the shaft member 450 penetrates a guide member 470 and an orifice member 480 and comes into contact at the other end with a valve means 460 disposed within a valve chamber 461. The diaphragm 430, the stopper member 440 and the shaft member 450 constitute the valve means drive mechanism. The orifice member 480 is fixed to the tube member 410 through a caulking portion $K_2$.

The spherical valve means 460 is supported by a support member 462, and the support member 462 is supported via a spring 464 by a fix plate 466.

A seal member 474 is inserted to the guide member 470 and fixed thereto by a support member 472.

The seal member 474 guides the shaft member 450 and prevents any possible leak between the refrigerant traveling toward the evaporator and the refrigerant returning therefrom.

The guide member 470 comprises a cylindrical outer contour, and is fixed to the cylindrical wall of the tube member 410 through a caulking portion $K_1$. A rubber bush member 490 is fit to the outer wall of the tube member 410 opposite the guide member 470.

Furthermore, a rubber bush member 492 is fit to the wall outside the valve chamber 461. A seal member 62*c* is disposed at a stepped portion 415 of the flange portion 411. The rubber bush members 490, 492 and the seal member 62*c* form a seal when the cassette unit 400 is inserted to the piping member 10.

The freedom of design of the expansion valve according to the present invention will now be explained with reference to FIGS. 5–8. In FIGS. 5–8, the components that are identical to those in FIG. 1 are provided with the same reference numbers, and the explanations thereof are omitted.

Figure 5:
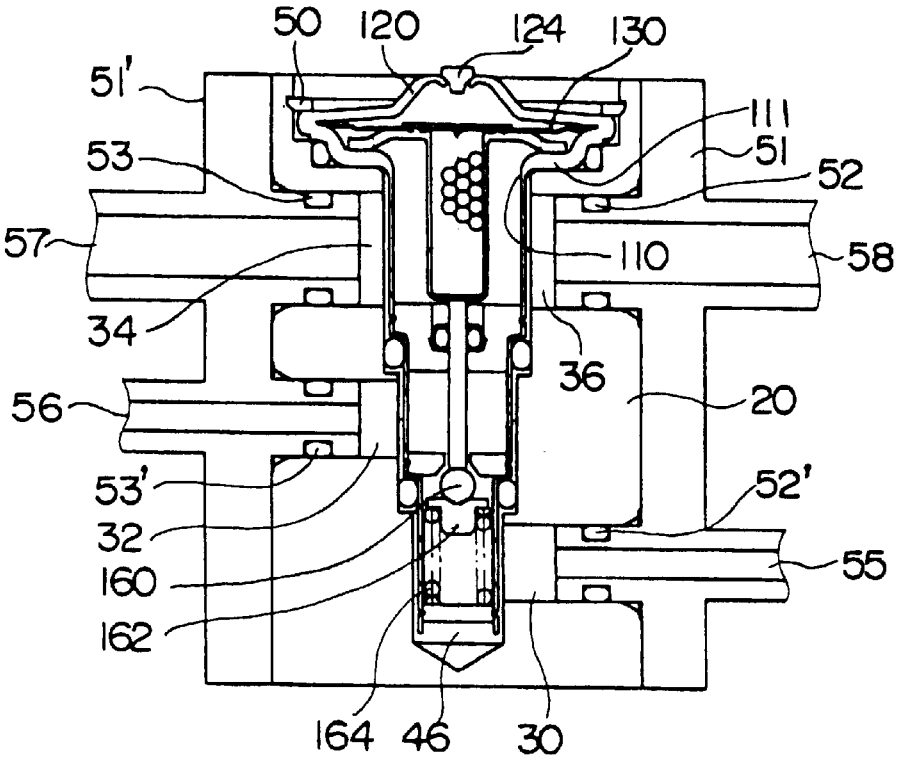
FIG. 5 is a cross-sectional view showing an example of the expansion valve piping according to the present invention.
Figure 6:
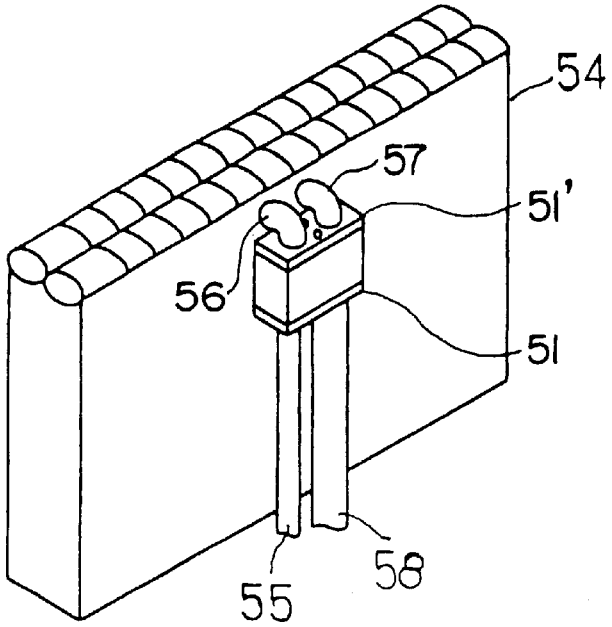
FIG. 6 is a cross-sectional view showing another example of the expansion valve piping according to the present invention.

FIG. 5 is a cross-sectional view showing an example of flange connection where flanges 51 and 51' are used to connect the refrigerant pipes to the expansion valve 1 upon mounting the expansion valve 1 according to the embodiment shown in FIG. 1 to the evaporator. In the drawing, flanges 51 and 51' are appropriately mounted in an airtight manner on a body 20 of a piping member 10 of the expansion valve 1 using o-rings 52, 52' and o-rings 53, 53'. FIG. 6 shows the expansion valve 1 connected to the evaporator by the flange connection.

FIG. 6 is a drawing showing the outline for connecting the expansion valve 1 of FIG. 1 to an evaporator 54. The refrigerant coming in from a compressor not shown is introduced via a pipe 55 to the refrigerant passage 30, travels through the refrigerant passage 32 and out toward the evaporator 54 via a pipe 56. After traveling through the evaporator 54, the refrigerant exiting the evaporator 54 flows through a pipe 57 into the refrigerant passage 34, travels through the refrigerant passage 36 and exits toward the compressor via a pipe 58. The pipes 55–58 are respectively connected to the flanges 51 and 51' for example by press-fit or insertion. Moreover, the pipes can be formed integrally with the flanges 51, 51'.

Figure 7:
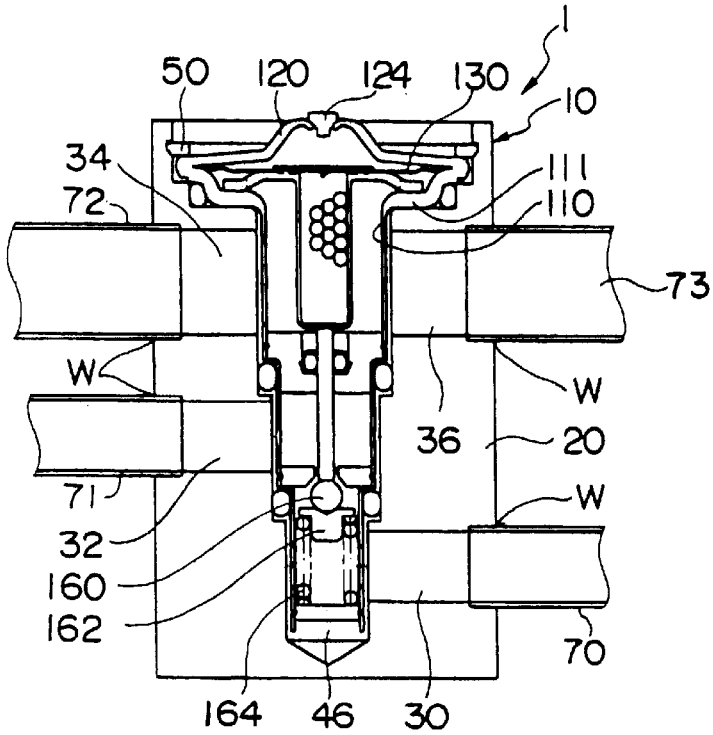
FIG. 7 is a cross-sectional view showing yet another example of the expansion valve piping according to the present invention.
Figure 8:
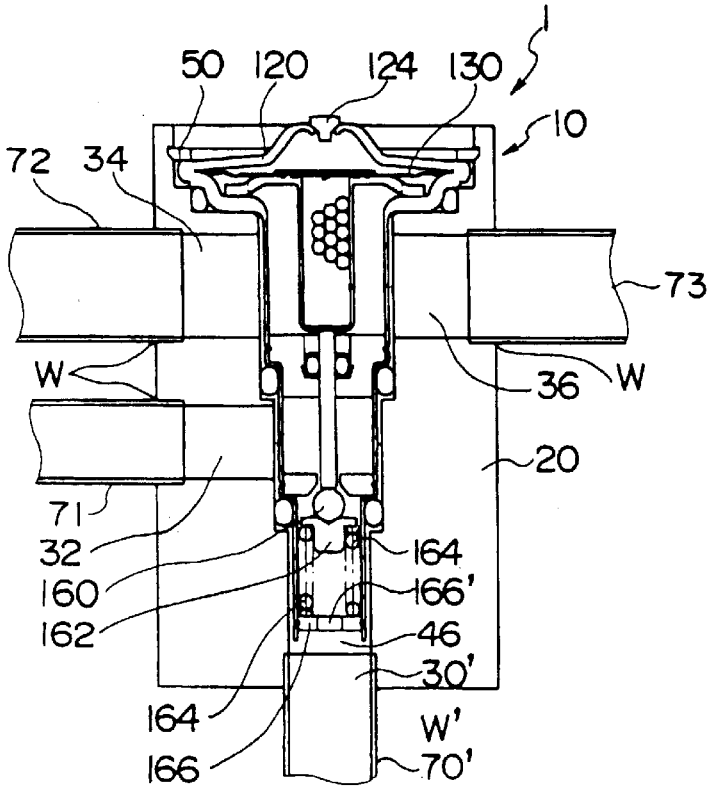
FIG. 8 is a cross-sectional view showing yet another example of the expansion valve piping according to the present invention.

Moreover, FIGS. 7 and 8 are drawings showing two examples of pipe connection, wherein upon connecting the pipes to the expansion valve 1 according to the embodiment shown in FIG. 1, the pipes are directly welded on to the body 20 of the piping member 10. In FIG. 7, pipes 70, 71, 72, and 73 made for example of aluminum are respectively connected to refrigerant passages 30, 32, 34, and 36 formed to the piping member body 20, and the pipes are fixed to the piping member body 20 through weld portions W.

FIG. 8 shows an example where according to the pipe connection of FIG. 7, the pipe 70 is connected to an inner (bottom) wall portion 46. A refrigerant passage 30' is formed to the piping member body 20 through which the refrigerant supplied from a compressor travels, the passage 30' being communicated to the inner bottom wall portion 46. A pipe 70' is welded to the passage 30' via a weld portion W' and thereby fixed to the piping member body 20. Further, FIG. 8 shows the case where a through hole 166' is formed to a plate member 166.

As explained above, the expansion valve according to the present invention comprises a piping member having pipes communicating the various equipments in the air conditioner and the expansion valve inserted thereto, and a cassette unit which is formed separately from the piping member and inserted to the piping member so as to exert the functions of the expansion valve, the expansion valve being manufactured by assembling the piping member and the cassette unit.

The method for connecting the refrigerant pipes or the design of the refrigerant passage formed in the piping member can be selected freely according to the layout of the air conditioner to which the present valve is applied, and thus, the design freedom is improved greatly.

According to the present invention, the structure of the cassette unit is simplified and the overall cost is reduced.

What is claimed is:

1. An expansion valve mounted to an air conditioner for controlling the flow of a refrigerant, the expansion valve comprising;

a piping member including refrigerant passages to which pipes communicated with various equipment of the the air conditioner are connected, the refrigerant passages including an upstream refrigerant supply passage, a downstream refrigerant supply passage and a refrigerant return passage;

a cassette unit inserted to the piping member, said cassette unit comprising a tube member formed integrally with a flange unit, a guide member disposed between the downstream refrigerant supply passage and the refrigerant return passage, an orifice member, and a plate member fixed to the inside of the tube member, a valve means disposed between the upstream and downstream refrigerant supply passages and equipped inside a valve chamber defined by said orifice member, a plate member further defining said valve chamber, a spring disposed between the plate member and the valve means for biasing the valve means toward the orifice member, a shaft member for driving the valve means, a lid member welded onto the flange portion, a diaphragm pinched between the lid member and the flange portion and defining a gas charge chamber, and a stopper member having at the center thereof a tubed portion filled with absorbent for transmitting the displacement of the diaphragm to the shaft member;

a ring for fixing to the piping member the lid member of the cassette unit inserted to the piping member; and three seal members disposed between the outer wall of the cassette unit and the inner wall of the piping member, a first seal member disposed in a vicinity of the valve means to prevent refrigerant leakage between the upstream refrigerant supply passage and the downstream refrigerant supply passage, a second seal member disposed in a vicinity of the guide member to prevent refrigerant leakage between the downstream refrigerant supply passage and the refrigerant return passage and a third seal member to prevent leakage of refrigerant from the refrigerant return passage passed the flange unit and exteriorly of the valve.

2. An expansion valve according to claim 1, wherein the axis line of the refrigerant passage formed to the piping member is designed to correspond to the layout of the pipes.

3. An expansion valve according to claim 1, wherein, at least one of the seal members is a rubber bush mounted to the exterior of the tube member.

4. An expansion valve according to claim 1, wherein, at least one of the seal members is a rubber seal member baked onto the exterior of the tube member.

5. An expansion valve according to claim 1, wherein the guide member, the orifice member, and the plate member are fixed to the tube member through caulking.

6. An expansion valve according to claim 1, wherein the third seal member contacts the flange unit.

* * * * *